US007090436B2

(12) United States Patent
Gunther

(10) Patent No.: US 7,090,436 B2
(45) Date of Patent: Aug. 15, 2006

(54) PROCESS TO PREPARE IN-SITU PILINGS IN CLAY SOIL

(76) Inventor: Johan M. Gunther, 1247 Lincoln Blvd. #140, Santa Monica, CA (US) 90401

( * ) Notice: Subject to any disclaimer, the term of this patent is extended or adjusted under 35 U.S.C. 154(b) by 0 days.

(21) Appl. No.: 10/899,449

(22) Filed: Jul. 26, 2004

(65) Prior Publication Data

US 2006/0018720 A1 Jan. 26, 2006

(51) Int. Cl.
*E02D 3/12* (2006.01)

(52) U.S. Cl. ..... 405/240; 405/236

(58) Field of Classification Search ..... 405/240, 405/236

See application file for complete search history.

(56) References Cited

U.S. PATENT DOCUMENTS

| | | | | |
|---|---|---|---|---|
| 4,286,900 | A | 9/1981 | Sugimoto | |
| 4,461,362 | A | 7/1984 | Staggs et al. | |
| 4,606,675 | A * | 8/1986 | Mitani et al. | 405/263 |
| 4,659,259 | A * | 4/1987 | Reed et al. | 405/263 |
| 4,940,366 | A | 7/1990 | Suzuki | |
| 5,026,216 | A * | 6/1991 | Koiwa | 405/267 |
| 5,135,058 | A * | 8/1992 | Millgard et al. | 175/71 |
| 5,228,809 | A | 7/1993 | Yoshida et al. | |
| 5,542,786 | A | 8/1996 | Blum | |
| 5,944,446 | A | 8/1999 | Hocking | |
| 5,967,700 | A | 10/1999 | Gunther | |
| 6,116,819 | A | 9/2000 | England | |
| 6,238,142 | B1 | 5/2001 | Harsch | |
| 6,685,398 | B1 * | 2/2004 | Gunther | 405/237 |
| 2001/0045067 | A1 * | 11/2001 | Cognon | 52/155 |
| 2004/0175242 | A1 * | 9/2004 | Kim | 405/269 |

FOREIGN PATENT DOCUMENTS

| | | | |
|---|---|---|---|
| EP | 0 411 560 01 | | 2/1991 |
| EP | 0411560 | B1 * | 2/1991 |
| JP | 57108313 | A | 7/1982 |
| JP | 58127828 | A | 7/1983 |
| JP | 02209519 | A | 8/1990 |

* cited by examiner

*Primary Examiner*—John Kreck
(74) *Attorney, Agent, or Firm*—Donald D. Mon

(57) ABSTRACT

A method of forming in-situ pilings in clay soil. An auger stirrer is rotatably and axially forced into the ground. Water, dry binder (cement/or lime), and air are injected to lubricate the tool, and liquify the mix of clay soil, binder and air to form a uniform structure, most of the air percolating from the mix before it hardens.

10 Claims, 1 Drawing Sheet

PROCESS TO PREPARE IN-SITU PILINGS IN CLAY SOIL

FIELD OF THE INVENTION

In clay soils, mixing a binder such as cement and lime, water, and air to provide a fluidized mix which after loss of much of its air forms a solid, cementitious and substantially homogenous piling.

BACKGROUND OF THE INVENTION

In his U.S. Pat. No. 5,967,700, issued Oct. 19, 1999 the applicant herein discloses apparatus and method to form an in-situ piling in existing soil. This patent is incorporated herein by reference in its entirety for its showing of apparatus to inject water and binder (such as cement and/or lime) into a soil structure, and for related methods. The apparatus mixes these materials, and after a time the mixtures solidifies to form the pilings. One object of the apparatus and method was to provide a suitable mixture at appropriate depths. Much of its advantage was the assurance that the stoichiometric amount of water was provided to react with the binder to make a cured product of suitable strength.

This procedure works well in all soils, but in clay soils it becomes of interest that surprisingly improved results can be attained. With the instant invention, they have been. Increased structural properties, reduced cost of binder, decreased cost of labor and capital equipment, increased speed of installation, and reduction of power to prepare the piling have been extraordinary and were not predicted. These results are principally achieved in clay soils. They are less likely and important in sandy or aggregate soils, although still worth while.

A clay soil is a rather "tough" structure—neither hard nor fluid, but sticky and unwieldy. It is difficult to cut through or to knead. In a word, it lacks "fluidity". This property leads to the problem of providing a piling that is suitably uniform in its composition. Known in-situ pilings often result in structures with sinews of cement surrounded by parent material. This does not form an optimal supportive structure.

Another problem in the prior art is the fact that after water and binder are mixed in, the top of the piling ends up far below the surface. Then there is a hole to be filled in, at considerable cost and aggravation.

Applicant herein has found that a sufficiently fluid in-situ mixture of parent clay, binder, water, and to a fugatious extent, air, can provide the consistency for a very suitable in-situ piling. Surprisingly, when so provided, a wide range of binder concentrations and process water can be accommodated, and surprisingly rapid first and final strengths are attained, all with a nearly homogenous consistently lateral cross section.

BRIEF DESCRIPTION OF THE INVENTION

This invention is accomplished with apparatus of the type shown in patent No. 5,967,700. Its purpose is to bore into the soil, disrupting and mixing it, and while doing so, injecting binder and water into the soil. Water is provided in a "stoichiometric" amount such that the amount of cement injected finds sufficient available water to hydrate it and harden the resulting piling.

Here a distinction must be recognized between "available" water and "bound" water. Bound water is held by the clay material, bound molecularly and also in "clusters" of bubbles. There are not available in useful amounts to hydrate the binder.

Confusion exists because when clay structures are analyzed for water content, a sample is weighed, oven dried, and then weighed. The difference is mostly the bound water. In some very wet samples, there may be more than that. As a consequence, if binder is provided in amounts to be hydrated by bound water in the sample, failure can reasonably be anticipated. Available water in amounts sufficient for hydration is necessary.

Clay soils have considerable interstices for occupation by binders, but the binders must reach them. This leads to the problem of fluidity (or fluidized) of the soil when cement and water are to be added. In clays and especially in stiff clays, their very stiffness resists this.

Accordingly, according to this invention, water is injected into the clay soil while the apparatus digs into it and stirs it. Importantly, while it is doing this, the water is accompanied by air. The air mixes in and lightens the mixture so it is more readily mixed. The air may be provided along with the binder as a propellant, or separately.

The cement is preferably injected after at least some of the air is injected, because the mix is then much more fluid. It is a feature of this invention that the fluidity of the mix is such that the air can rise and leave the piling. Thus it does not appreciably increase the volume of the resulting piling. In fact, the surface may appear a bit foamy because the air is leaving.

Of significant importance, and an optimal advantage of this invention, is that when the parent soil includes a hard dry crust, the top of the resulting piling will stand about at surface level.

The above and other features of this invention will be fully understood from the following detailed description and the accompanying drawing in which:

BRIEF DESCRIPTION OF THE DRAWINGS

The system utilized to carry out the methods of this invention is schematically shown in the single FIGURE., namely FIG. 1. An air supply 10 supplying air under pressure feeds the air into conduit 11. A first conduit branch 12 leads to a dry binder supply 13.

Conduit 12 includes a control valve 13 which can stop or regulate the flow of air into binder supply which discharges into dry binder 14, which discharges into feed conduit 15. This can continue the rate of supply of dry binder. Alternatively, a feeder wheel or the like (not shown) could feed cement (or not) into the air flow from first branch conduit into feed conduit 15.

Figure 1:
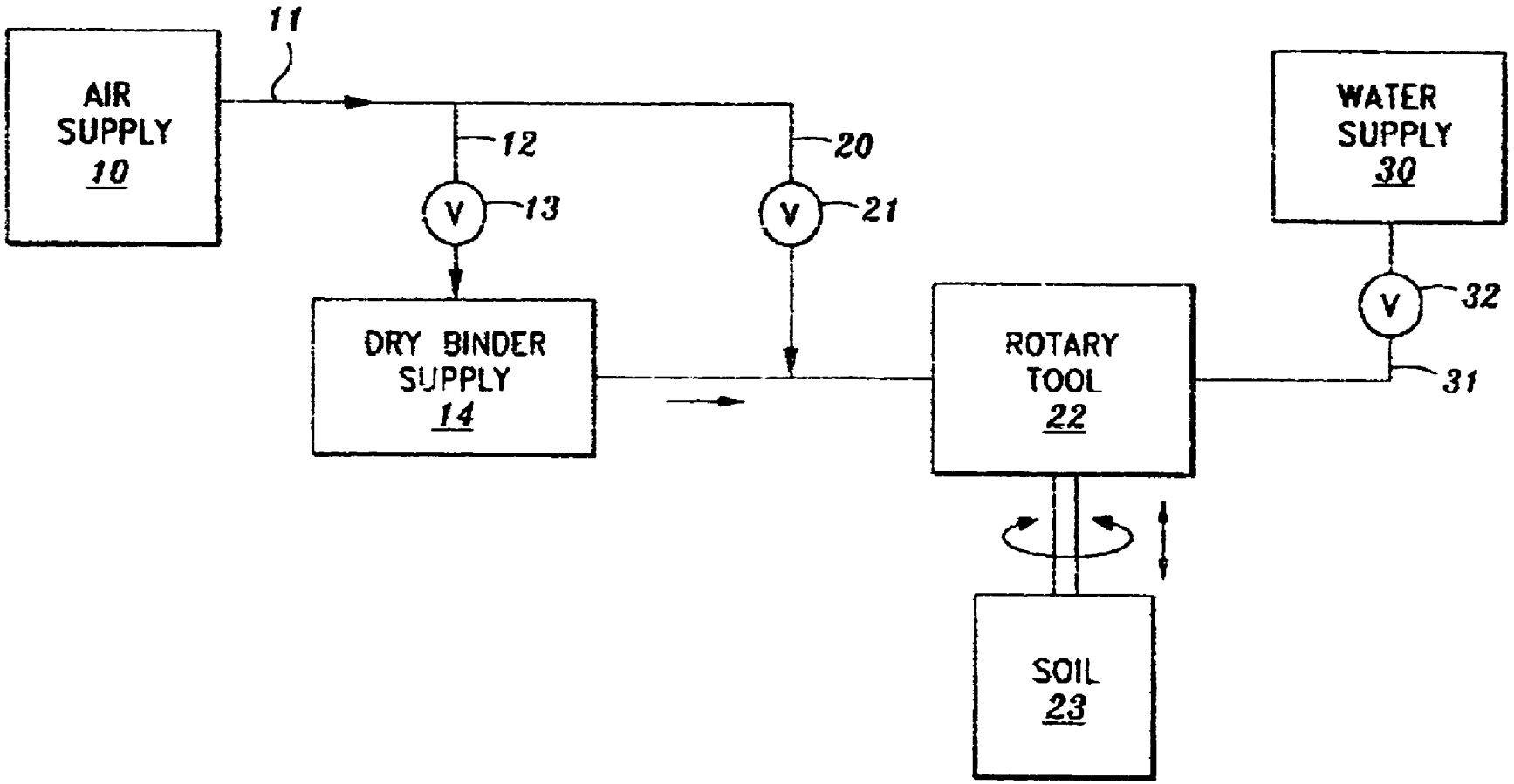

A second branch conduit 20 from conduit 11 includes a control valve 21 that can stop or regulate the flow rate of air into feed conduit 15.

A rotary tool 22 is reversibly driven in, and is reciprocable in, soil 23. A water supply 30 leads to rotary tool through a water conduit 31. Water conduit 31 includes a control valve 32, which can stop or regulate the flow of water to the rotary tool.

As will later be shown, the air, dry binder and water are supplied to the rotary tool as required by the conditions in the bore. The air and cement are supplied to the tool separately from the water. They are mixed in-situ by the rotary tool after having been injected into the soil.

DETAILED DESCRIPTION OF THE INVENTION

A piling to be produced is similar in shape to those shown and described in Pat. Nos. 5,967,700 and 6,685,399, produced by apparatus similar to those shown in them which are incorporated herein in their entirety for their disclosures of apparatus and method.

The objective of these patents is to inject into soil binders such as cement and/or lime, water to provide a stoichiometric amount to hydrate the amount of binder injected. In many soils this is an adequate objective, but for other soils, particularly heavy clays, or drier clays, the resulting piling while useful is not optimum.

With this invention, for example in a heavy clay it is possible to form a 24 inch diameter, 30 foot depth piling with the injection of 1½ tons of cement, to produce a piling with 800 psi unconfined compression pressure test. This is well in excess of results attainable without the improvements of this invention.

According to this invention, an auger/stirrer of the type shown in either of the referenced patents is forced into the soil while being rotated. On the way down water is injected to start the fluidizing of the soil. Air is injected at this time, also to loosen and fluidize it. In some situations, some binder may also be injected on the way down.

On the way back up, the tool will continue to be rotated, and binder injected. Binder is customarily injected by being incorporated into a flowing air stream which further assists the efluidizing of the mix.

When the tool returns to the surface there remains a subsurface cylindrical region of well-mixed clay, water and binder that is to become the piling. As to the air, the fluidizing of the mix is such that a significant amount of the air will bubble or percolate to the top. Examination of cured cores show only minor cavities. The resulting piling is quite consistent in cross-section.

It is known to transport the binder by an air stream, and accordingly, some air historically has been injected into the mix along with the binder. However, it has been provided for binder transport, and to keep the air line from plugging up. In this invention, the air is used as part of the mix although fugaciously. Its presence is for fluidizing the material before curing, and most of it will be seen rising to the surface and leaving the mix.

In the prior art, there results in clay structures, both those having an upper hard dry crust and those which do not, a tendency for the upper surface of the piling to be well beneath the ground level. With this invention, the top surface will most often be at ground level, or some may rise above it to be scooped away. This is a considerable saving above having to fill in the hole and compact its contents. The reason this occurs is not well understood, but the situation is real.

As can be seen from the above, the fluidizing of the mixture is pivotal to making a consistent piling in clay soils. It is also pivotal to the energy requirements needed for this purpose. Attempts to press dry apparatus, into the soil generally result in a stuck tool. Injecting the binder stream into a non-fluidized region can result in tendril-like piling structures. A well-mixed composition is needed, which in clay is difficult to the extent of near-impossibility, without the improvements of this invention.

The amount of binder will ordinarily be decided by the desired ultimate strength of piling, which is a routine calculation. Once this is set, the amount of available water will be calculated to hydrate it. This must be added. The calculation for this is also routine.

Then, additional water and binder (dry) and air is added maintaining interrelated correct amounts, to produce the aforementioned desired state of fluidity that creates interstructural conditions for the air to escape at the top and some of the soil to be mixed axially by the escaping air.

The resulting extra/additional dry binder and water added to the structure can as well be designed to ensure that the column/piling is produced all the way to the surface or any other desired point related to the ground level.

There remains the decision about how much air is to be used. It is surprisingly large. For example, in a 24 inch diameter 40 foot deep piling in a heavily saturated clay, about 25–40 cubic yards of air between about 50 to 150 psi will be injected. This includes air which transports the binder. This surprisingly large volume of air largely dissipates from the piling before it is set with the present invention. It dissipates vertically, and not horizontally due to the fluidity of the air. It has no effect on the final condition of the piling, but a very large influence on its consistency.

This surprisingly large amount of air largely dissipates from the piling before it is set in the present invention. In prior art a heaving of the surrounding ground has been observed.

This invention is not to be limited by the embodiment shown in the drawings and described in the description, which is given by way of example and not of limitation, but only in accordance with the scope of the appended claims.

I claim:

1. The method of forming an in-situ piling in a clay soil structure containing bound water and perhaps also some available water, said piling ultimately to be comprised of the mixed composition of the native clay soil which existed in the volume to be occupied by the completed piling, dry binder, supplied by this method, and such water as remains in the piling after hydration of the dry binder, by available and added water, said method comprising:

a. using a rotary tool adapted to auger into the clay soil and stir it, forcing it while rotating into the soil structure to form a circularly sectioned columnar region of loosened and stirred said native clay soil;

b. while performing step a, injecting into said region water to lubricate the clay soil relative to the tool to facilitate the tool's movement into said native clay soil;

c. while performing steps a and b, also injecting air into the said region to loosen and fluidize the soil;

d. while continuing to rotate the tool, withdrawing it from said region; and e. during either of steps a or d, or both, injecting dry binder of the type which reacts with water into said region and stirring the mixture in the region thoroughly to mix the said clay soil, water, air and binder;

said binder being added in amounts intended to be sufficient to form a piling structure of anticipated strength, said water being added to already existing available water to provide water in at least stoichiometric quantity to hydrate all of said binder, and said air being supplied at rates, pressures, and volumes sufficient to convey said binder into said soil and to provide fluidity, along with said water, of said mixture so as to facilitate forming a uniform said mixed composition, said mixture before setting being sufficiently fluid as to permit sufficient air to percolate through and exit vertically from said mixture as will result in a piling devoid of substantial internal cavities.

2. A method according to claim 1 in which dry binder is supplied during entry of the tool.

3. A method according to claim 1 in which dry binder is supplied during withdrawal of the tool.

4. A method according to claim 1 in which dry binder is supplied during both entry and withdrawal of the tool.

5. A method according to claim 1 in which the dry binder is cement, or lime, or a combination of cement and lime.

6. A method according to claim 5 in which dry binder is supplied during entry of the tool.

7. A method according to claim 5 in which dry binder is supplied during withdrawal of the tool.

8. A method according to claim 5 in which dry binder is supplied during both entry and withdrawal of the tool.

9. A method according to claim 1 including the following additional steps:

f. permitting said air to percolate through and exit from said mixture; and g. leaving the piling to cure as the consequence of hydration of the binder.

10. A method according to claim 9 in which the dry binder is cement or lime, or a combination of cement and lime.

* * * * *